US005394051A

United States Patent [19]

Lerner

[11] Patent Number: 5,394,051

[45] Date of Patent: Feb. 28, 1995

[54] VIBRATION-DAMPING CONFIGURATION IN A STRIP SHADOW MASK

[75] Inventor: Martin L. Lerner, River Forest, Ill.

[73] Assignee: Zenith Electronics Corporation, Glenview, Ill.

[21] Appl. No.: 997,409

[22] Filed: Dec. 28, 1992

[51] Int. Cl.[6] ..... H01J 29/81

[52] U.S. Cl. ..... 313/403; 313/402; 313/407; 313/269

[58] Field of Search ..... 313/402, 403, 407, 269

[56] References Cited

U.S. PATENT DOCUMENTS

| | | | |
|---|---|---|---|
| 2,757,303 | 7/1956 | Silverman | 313/269 |
| 3,638,063 | 1/1972 | Tachikawa et al. | 313/269 |
| 4,714,863 | 12/1987 | Yokoyama et al. | 313/269 |
| 4,780,641 | 10/1988 | Hashiba et al. | 313/407 |

*Primary Examiner*—Donald J. Yusko
*Assistant Examiner*—Matthew J. Esserman
*Attorney, Agent, or Firm*—Ralph E. Clarke, Jr.; Roland W. Norris

[57] ABSTRACT

A tension shadow mask CRT front assembly includes a flat strip shadow mask having a first wire and a second wire in contact with the strips of the mask on opposite sides of the mask for damping strip vibration. The two wires may be spaced apart on opposite sides of the mask, or lie directly opposite. If the wires are directly opposite, they may be formed from a single wire welded into a loop. The wires are held in tension by a spring attached to, and extending from, the inner surface of the faceplate.

10 Claims, 4 Drawing Sheets

VIBRATION-DAMPING CONFIGURATION IN A STRIP SHADOW MASK

CROSS REFERENCE TO RELATED APPLICATIONS

This application is related to but in no way dependent on copending application Ser. No. 07/997,410 filed Dec. 28, 1992, and application Ser. No. 07/998,093 filed Dec. 28, 1992, both of common ownership herewith.

1. Field of the Invention

This invention relates to tension shadow mask color cathode ray tubes having a strip shadow mask in conjunction with a flat faceplate. The invention is addressed particularly to an improved means for damping picture-distorting vibration of the strips of the mask.

2. Discussion of Related Art

An FTM CRT and its front assembly known in the art, and which utilizes a strip shadow mask, is depicted in FIGS. 1 and 2. CRT 20 has a front assembly 22 that includes a rectangular flat glass faceplate 24 which is sealed to a funnel 26.

As indicated in FIG. 2, the faceplate 24 is oriented with respect to two axes: an x-axis coordinate, also known as the x-axis and the horizontal axis, and a y-axis coordinate, also known as the y-axis and vertical axis.

The neck 28 that extends from the funnel 26 encloses an electron gun 30 which projects three discrete electron beams 32 that energize a substantially striped imaging screen 38 that consists of colored-light-emitting phosphors deposited on the inner surface 44 of the faceplate 24, producing a color image visible from the outer surface 40 of faceplate 24. The long axis of each stripe is in parallel with the y-axis of the faceplate. The deposits of phosphor are interspersed with a matrix, or "black surround" (not indicated).

Two shadow mask supports 48 and 50 are attached to the inner surface 44 of faceplate 24 for mountings strip shadow mask 52. An inset 54 depicts a representative section of the shadow mask 52 greatly enlarged. Shadow mask 52 consists of a plurality of strips 56 spaced apart by intervening slits 58.

For descriptive purposes in this disclosure, the mask 52 is further considered to have a top and a bottom consisting, respectively, of a top border 60 and a bottom border 62, and to have two marginal areas, a left marginal area 64 and a right marginal area 66. The two surfaces of the mask 52 are identified as the "screen side" 65 (FIG. 1) of the mask 52; that is, the surface of the mask 52 adjacent to the screen 38; and the "electron gun side" 67 (FIG. 2) of the mask 52; that is, the surface of the mask 52 nearest to the electron gun 30.

The mask 52 is formed from a metallic foil which may have a thickness in the range of 0.0003 inch to 0.005 inch, with the thickness dependent on the size and application of the CRT. Such thin foils are basically non-self-supporting so they must be installed in a highly tensed state on the shadow mask supports or rails. Also, the magnitude of the tension must be high enough so that the tension is not lost when the mask expands thermally during operation. By way of example, the tension of a foil mask for a 14-inch (diagonal measure) CRT is about 40 lb./in.

The strips 56, which are unsupported the full height of the mask 52 and are under tension, tend to vibrate independently at a fundamental natural frequency of about 400 Hz, initiated by such influences as the impact of the electron beams, mechanical shock, and vibration induced by a nearby loudspeaker or a cooling fan, or other source of loud, cyclical noise. The movement of the strips 56 in relation to the fixed phosphor stripes impairs the proper landing of the electron beams on the phosphor stripes, with resulting picture distortion.

Strip vibration can be damped by some form of physical contact with each of the strips, as disclosed in U.S. Pat. No. 3,638,063 to Tachikawa et al. As indicated by FIG. 3, the Tachikawa et al mask 166 consists of a parallel array of narrow strips 167, the ends of which are attached to a curved spring frame 168 which holds the strips 167 under tension, forming a sector of a cylindrical surface. Disadvantages inherent in a mask assembly of this type include its bulk and weight and the tendency of the strips to vibrate. The latter deficiency is remedied in Tachikawa et al by suspending a fine wire 172 from tabs 174, 175 attached to the mask frame and pieces 170, 171, which serves to dampen vibration by the physical contact of the wire 172 with the strips 167.

Damping strip vibration is a particular problem in an FTM CRT which has a strip shadow mask mounted on rails affixed to a flat faceplate. The associated shadow mask is flat rather than curved as in Tachikawa et al, so positive and uniform contact of a vibration-damping wire with all of the strips of the mask presents a singular problem which is addressed by the present invention. Further, and unlike Tachikawa et al, there are no structures available nearby for suspending a vibration-damping wire.

OBJECTS OF THE INVENTION

It is among the objects of the invention to:

(a) provide improved means for damping the vibration of a flat strip shadow mask mounted in conjunction with a flat faceplate;

(b) provide means for positive and uniform contact of the vibration-damping wire or wires with the strips of the mask; and (c) provide vibration-damping means which do not distort the ask at the margins due to pressure of the wire as it passes over the marginal areas of the mask.

BRIEF DESCRIPTION OF THE DRAWINGS

The features of the present invention which are believed to be novel are set forth with particularity in the appended claims. The invention, together with further objects and advantages thereof, may be best understood by reference to the following description taken in conjunction with the accompanying drawings (not to scale) in the several figures of which like reference numerals identify like elements, and in which:

DESCRIPTION OF THE PREFERRED EMBODIMENT

Figure 1:
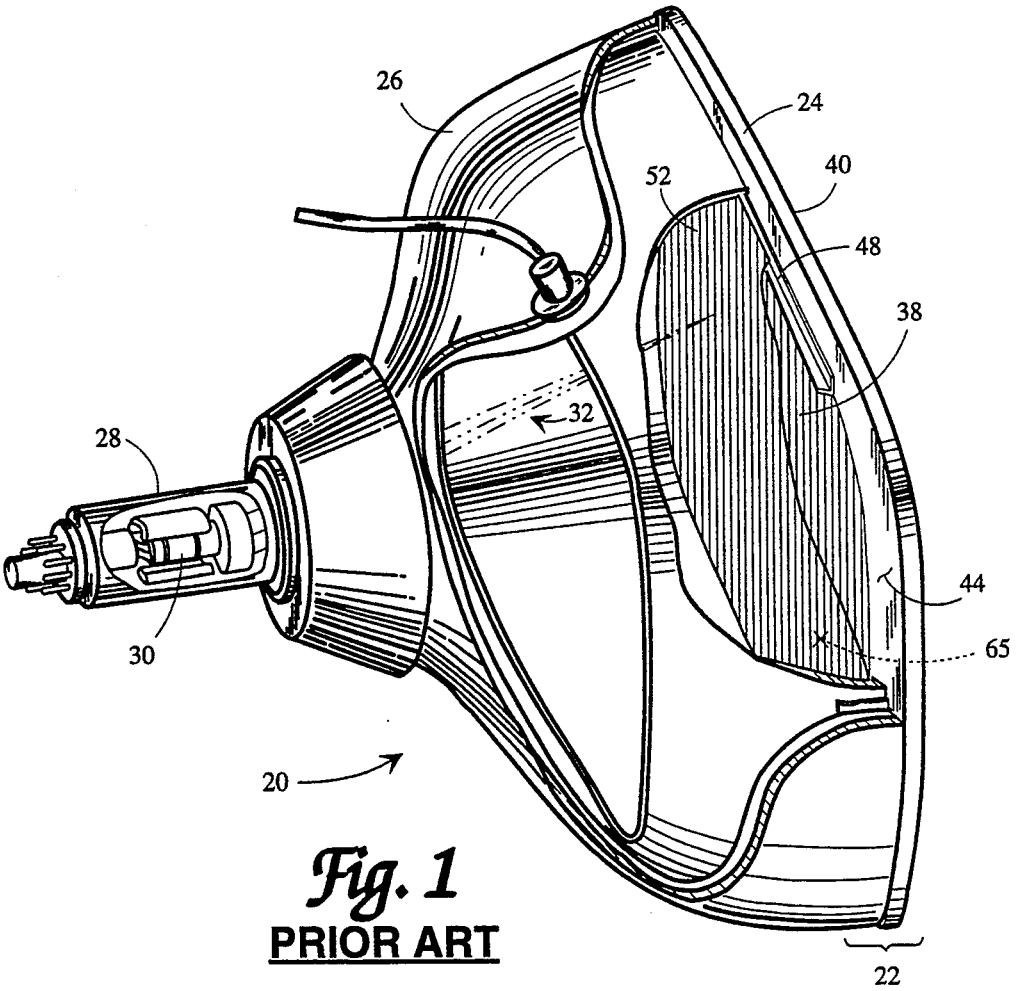
Fig. 1 PRIOR ART
FIG. 1 is a side view in perspective of a striped-screen tension mask color CRT known in the art, with cutaway sections that reveal the location and relationship of the major components of the tube.
Figure 2:
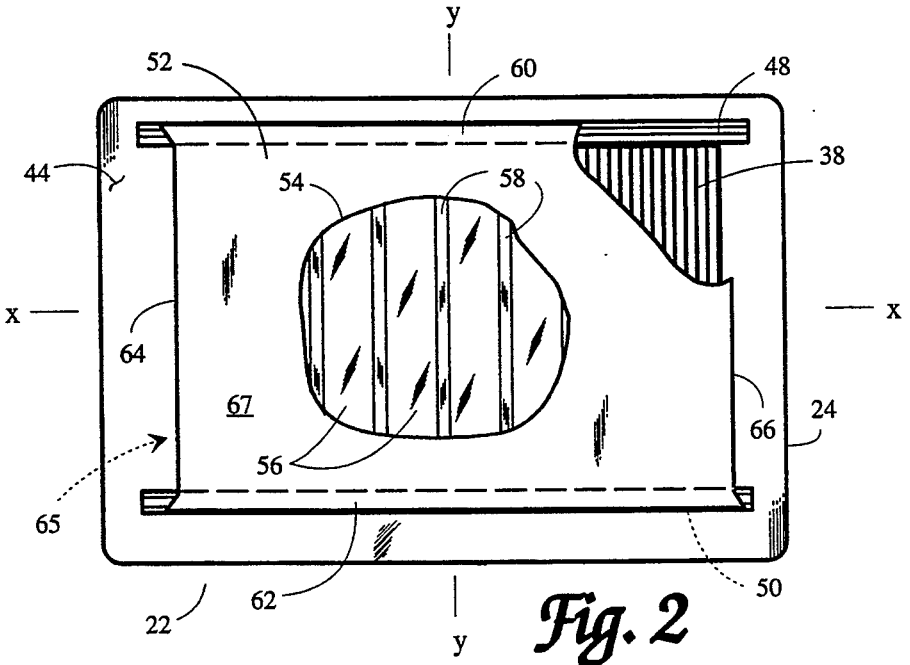
Fig. 2 PRIOR ART
FIG. 2 is a plan view of the front assembly of the CRT of FIG. 1 as seen from the viewpoint of the electron gun, and with parts cut away to show the relationship of a strip shadow mask with the faceplate and the striped imaging screen; an inset depicts the strips of the mask greatly enlarged.
Figure 3:
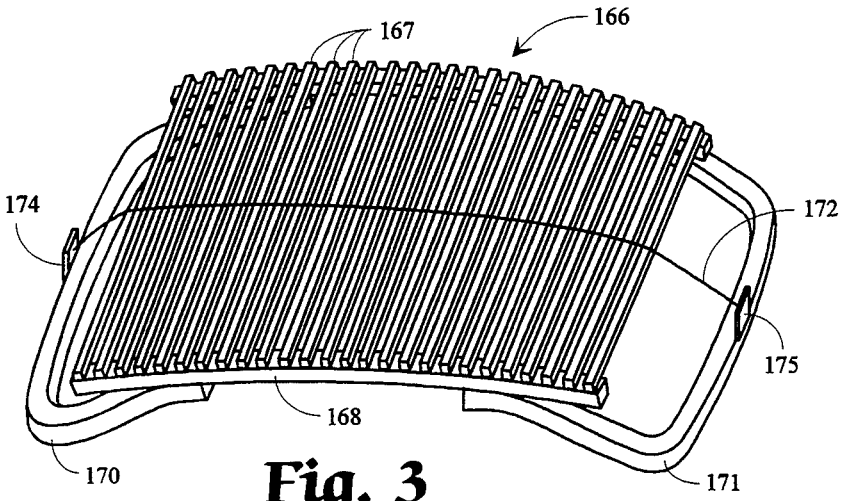
Fig. 3 PRIOR ART
FIG. 3 is a schematic view in perspective of a prior art strip mask.
Figure 4:
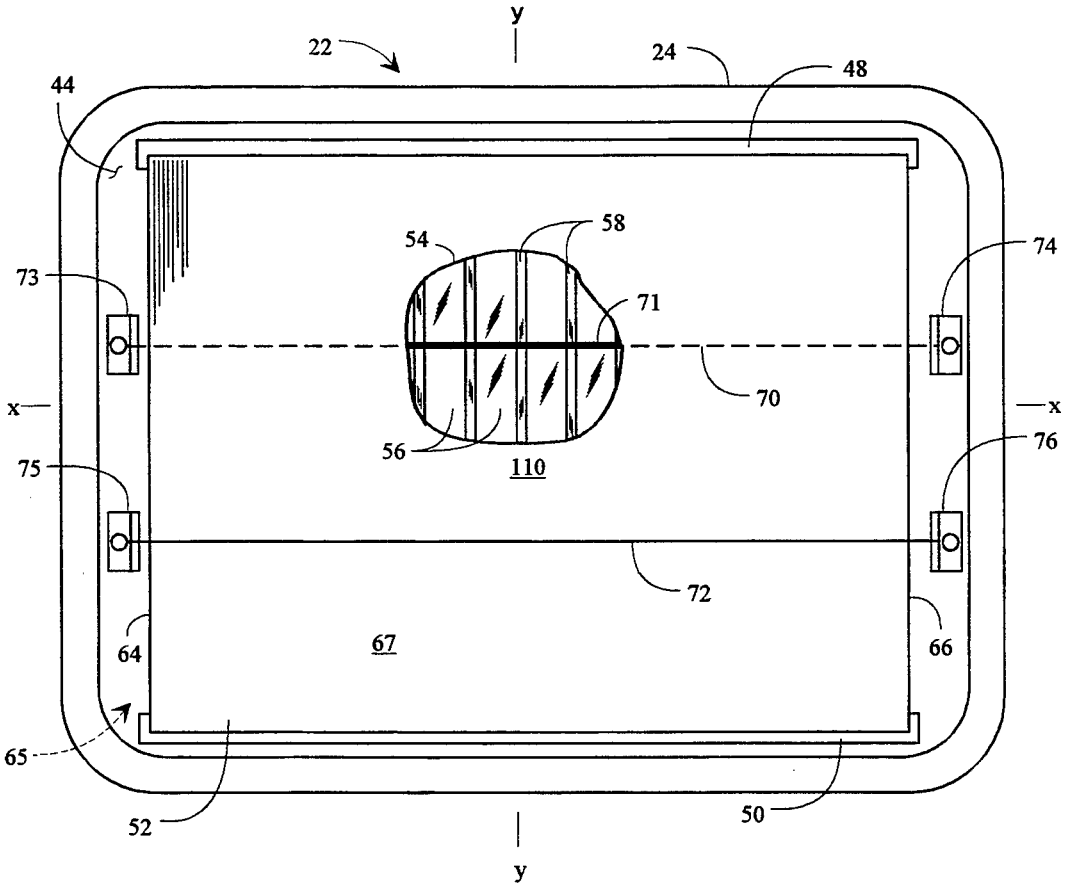
FIG. 4 is a plan view of the front assembly depicted in FIGS. 1 and 2, showing a means according to the invention for effective damping of the vibration of the strips.

FIG. 4 is a view of a strip shadow mask for a tension mask CRT. The figure is based on the strip mask 52 depicted in FIGS. 1 and 2 fabricated so as to have an improved vibration-damping means according to the invention. As has been noted, shadow mask 52 is attached to rails 48 and 50 which are in turn attached to the faceplate 24. Shadow mask 52 consists of strips 56 separated by slits 58, as indicated by the inset 54.

A first wire 70 and a second wire 72 are in parallel with the x-axis of the faceplate 24 and in contact with the strips 56 of the mask 52. The first wire 70, a section 71 of which is visible through the inset 54, is located on the screen side 65 of the mask 52. A second wire 72 is located on the electron gun side 67 of the mask 52. The two wires 70 and 72 lie on opposite sides of the mask 52 on separate y-axis coordinates, and effectively dampen image-distorting strip vibration by their contact with the strips 56 of mask 52.

The front assembly 22 includes means for suspending the first wire 70 and the second wire 72 in tension. The means for suspending in the embodiment of FIG. 4 are springs attached to, and extending from, the inner surface 44 of the faceplate 24. The springs are in the form of stanchions. Stanchion 73, located in the left marginal area 64 of the mask 52, and stanchion 74, located in the right marginal area 66, suspend the first wire 70 in tension. Stanchion 75, located in the left marginal area 64, and stanchion 76, located in the right marginal area 66, support the second wire 72 in tension.

Figure 5:
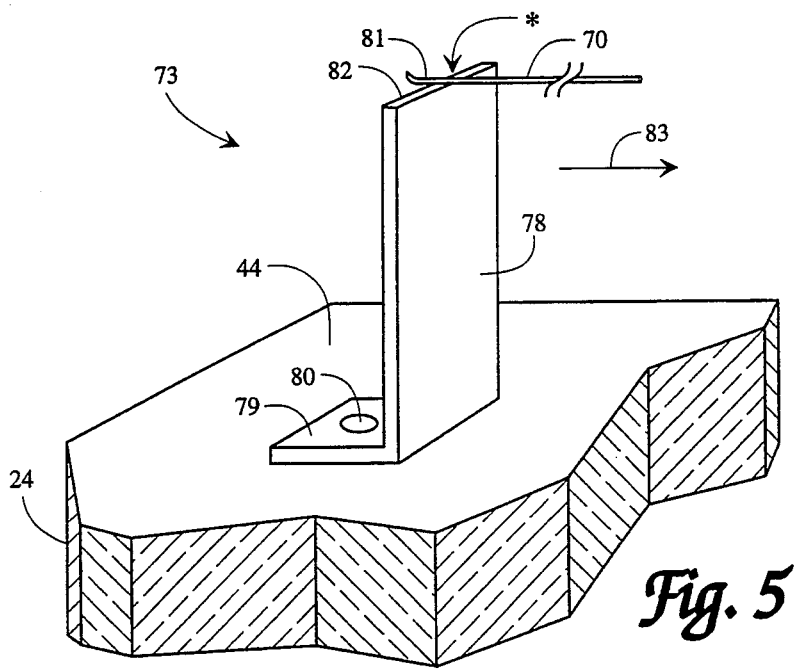
FIG. 5 is a detail view in perspective of a representative one of spring means according to the invention for suspending vibration-damping wires in tension.

The details of the construction of the four stanchions 73, 74, 75 and 76, which are identical, are depicted in FIG. 5, using stanchion 73 as an example. Stanchions 74 and 76, located in the marginal area 66, are in facing relationship with respective stanchions 73 and 75, located oppositely in marginal area 64.

The stanchion 73 is shown as comprising a rectangular leaf spring 78 that includes a foot 79 attached to the inner surface 44 of the faceplate 24. The fool 79 may be affixed to the inner surface 44 by means of a devitrifying solder glass or other high-temperature-tolerant cement. The attachment may be by means of a "button" weld 80; that is, a weld made by inserting the welding cement into a perforation (not shown)in the foot 79 of leaf spring 78, and in contact with the inner surface 44 of faceplate 24. The end 81 of the first wire 70 preferably attached to the top 82 of leaf spring 78 by welding, as indicated by the weld symbol (*).

The opposite end of the first wire 70 is similarly attached to the stanchion 74. The ends of the second wire 72 are similarly attached to the tops of stanchions 75 and 76 for suspension between the stanchions.

Tension is applied to the two wires 70 and 72 by the flexing of the respective leaf springs of the stanchions, typified by leaf spring 78 of stanchion 73, inwardly toward the center of the mask 52, a direction indicated by arrow 83 in FIG. 5. The ultimate tension of the vibration-damping wires 70 and 72 is a function of the length of the wires and the extent of the deformation of the respective leaf springs that comprise the stanchions 73–76 toward the center of the mask 52.

Figure 6:
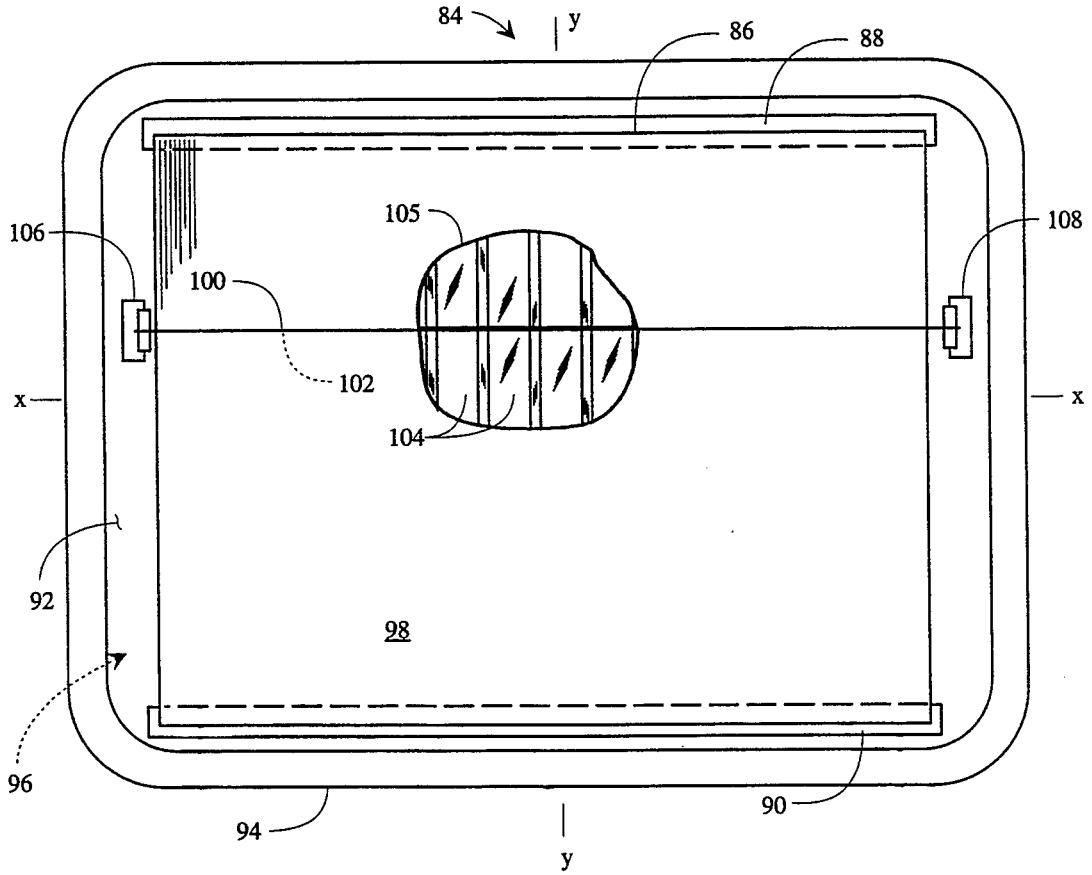
FIG. 6 is a plan view of a front assembly similar to the view of FIG. 4 depicting another aspect of the preferred embodiment.

FIG. 6 is a depiction of another aspect of the preferred embodiment. A front assembly 84 essentially identical to the front assembly 22 described heretofore has a flat strip shadow mask 86 mounted on respective mask supports 88 and 90 which are attached to the inner surface 92 of the faceplate 94. Mask 86 has a screen side 96 and an electron gun side 98. A first wire 100 and a second wire 102 are in parallel with the x-axis of the faceplate, and lie directly opposite each other on opposite sides of mask 86 on substantially the same y-axis coordinate; that is, the first wire 100 lies on the electron gun side 98 of the mask 86, and the second wire 102 lies on the screen side 96 of the mask 86. The benefit of a wire configuration of this type is that the two wires 100 and 102 effectively clasp the strips 104 of the mask 86 (indicated by inset 105 in FIG. 6) to dampen image-distorting vibration of the strips 104.

Figure 7:
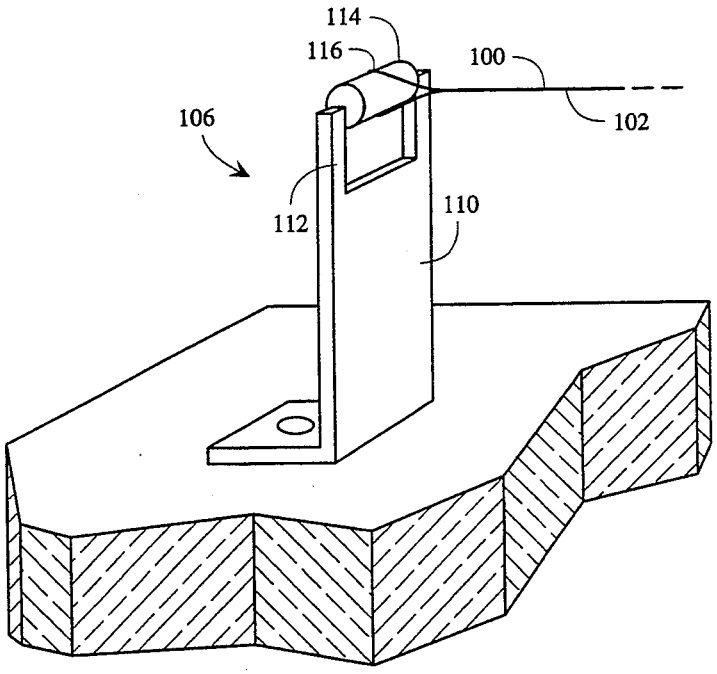
FIG. 7 is a view similar to five 5 depicting another configuration of spring means for suspending vibration-damping wires in tension.

The damping wires 100 and 102 are suspended between two stanchions 106 and 108 that are in facing relationship, but otherwise identical. Stanchion 106, shown by FIG. 7, and which is used as an example, resembles stanchion 73 depicted in FIG. 5, but with a significant difference. The leaf spring 110 of the stanchion 106 is topped with a stirrup 112 that encloses a ring 114 for receiving a loop 116 formed by a junction of the first and second wires 100 and 102.

Figure 8:
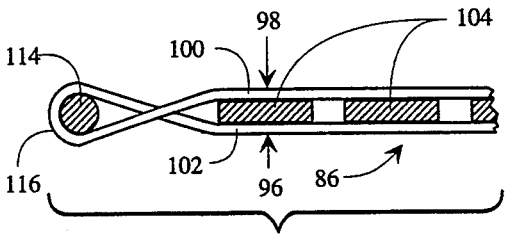
FIG. 8 is a cross-sectional detail view of means of attachment of vibration-damping wires to a spring means according to the invention.

The means for retaining the two wires 100 and 102 is depicted in detail in the sectional view of FIG. 8. The first wire 100, located on the electron gun side 98 of the mask 86, is shown as crossing under ring 114. The second wire 102, located on the screen side 96 of mask 86 joins with first wire 100 and crosses over ring 114 to form a loop 116. The second wire 102 then continues on to lie in contact with the screen side 96 of the mask 86. It is by this means that the strips 104 of the mask 86 are clasped by the the first wife 100 and second wire 102 to provide positive and uniform contact of the vibration-damping wires with the strips of the mask, thus enhancing the vibration-damping effect. A further benefit lies in the fact that the strips at the margins of the mask are not deflected out of the plane of the mask by the pressure of the wires, as would be the case when a single vibration-damping wire is used.

Figure 9:
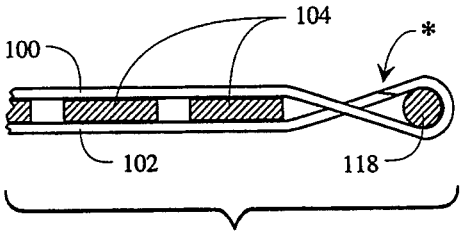
FIG. 9 is a view similar to FIG. 8 indicating the attachment of vibration-damping wires to a component of spring means located opposite to the spring means of FIG. 8.

FIG. 9 depicts the ring 118 of the stanchion 108 that is located opposite to the stanchion 106, depicted in FIG. 6. The first wire 100 and the second wire 102 may be formed from a single wire welded into a loop by welding them together at the weld .point indicated by the weld symbol (*).

According to the invention, there may be two such sets of first and second wires spaced apart on different y-axis coordinates.

A suitable fixture can be used in manufacture for flexing the spring means of the stanchions inwardly toward the center of the mask in preparation for attaching the vibration-damping wires. The length of the wires is preferably adjusted to deflect the leaf springs of the stanchions sufficiently to provide the proper tension on the wires.

The vibration-damping wires must be able to withstand the tension applied, yet be so small in diameter as to be relatively invisible on the imaging screen. A tension of four grams has been suggested for a wire of 0.0005-inch diameter. This relatively low tension makes possible a wider choice of materials for forming a vibration-damping wire. For example, a vibration-damping wire may be made of stainless steel as well as tungsten.

The leaf springs that make up the structure of stanchions preferably comprise Hastelloy B (TM) nickel alloy about 0.020 inch thick. The tension on a vibration-damping wire is a function of the width and thus the flexibility of a stanchion; a width of 0.25 inch is suggested by way of example.

The desired height of a stanchion depends upon the distance between the screen side of the mask and the inner surface of the faceplate, a dimension known as the "Q-distance." Depending on whether it is located on the electron gun side or the screen gun side of the mask, a vibration-damping wire is preferably suspended at slightly less or slightly greater than the Q-distance, which will cause the wire to rest on the strips of the mask with a very slight pressure.

While a particular embodiment of the invention has been shown and described, it will be readily apparent to those skilled in the art that changes and modifications may be made in the inventive means without departing from the invention in its broader aspects. Therefore, the aim of the appended claims is to cover all such changes and modifications as fall within the true spirit and scope of the invention.

What is claimed is:

1. A tension shadow mask CRT front assembly, comprising:

a) a flat faceplate having a substantially striped imaging screen on its inner surface energized by an electron gun, with the long axis of the stripes in parallel with the y-axis of the faceplate;

b) a flat strip shadow mask having a screen side and an electron gun side;

c) a first wire and a second wire in parallel with the x-axis of the faceplate and in contact with the strips of the mask;

1) the first wire located on an electron gun side of the mask; and 2) the second wire located on a screen side of the mask;

whereby the two wires effectively dampen image-distorting strip vibration.

2. The tension mask CRT front assembly of claim 1 including means for suspending the first and second wires in tension.

3. The tension mask CRT front assembly of claim 2 wherein the means for suspending the first and second wires in tension comprise spring means attached to, and extending from, the inner surface of the faceplate.

4. The tension mask CRT front assembly of claim 1 wherein the first wire and the second wire lie on opposite sides of the mask on separate y-axis coordinates.

5. The tension mask CRT front assembly of claim 1 wherein the first wire and the second wire lie directly opposite each other on opposite sides of the mask on substantially the same y-axis coordinate.

6. The tension mask CRT front assembly of claim 5 wherein the first wire and the second wire are formed from a single wire welded into a loop.

7. A tension mask CRT front assembly, comprising:

a) a faceplate having a substantially striped imaging screen on its inner surface energized by an electron gun, with the long axis of the stripes in parallel with the y-axis of the faceplate;

b) a flat strip shadow mask having a screen side and an electron gun side;

c) shadow mask supports attached to the faceplate;

d) the shadow mask attached to the shadow mask supports;

e) a first wire and a second wire in parallel with the x-axis of the faceplate and in contact with the strips of the mask;

1) the first wire lying on the electron gun side of the mask;

2) the second wire lying on the screen side of the mask on substantially the same y-axis coordinate as the first wire;

whereby the two wires effectively clasp the strips of the mask and image-distorting vibration of the strips is damped.

8. The tension mask CRT front assembly of claim 7 including means for suspending the first wire and second wire in tension.

9. The tension mask CRT front assembly of claim 8 wherein the means for suspending the first and second wires in tension comprise spring means attached to, and extending from, the inner surface of the faceplate.

10. The tension mask CRT front assembly according to claim 8 wherein the first wire and the second wire are formed from a single wire welded into a loop.

* * * * *